US007969403B2

(12) United States Patent
Sheu

(10) Patent No.: US 7,969,403 B2
(45) Date of Patent: Jun. 28, 2011

(54) DRIVING CIRCUIT, DRIVING METHOD, AND LIQUID CRYSTAL DISPLAY USING SAME

(75) Inventor: Yi-Zhong Sheu, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 911 days.

(21) Appl. No.: 11/978,267

(22) Filed: Oct. 29, 2007

(65) Prior Publication Data

US 2008/0100557 A1 May 1, 2008

(30) Foreign Application Priority Data

Oct. 27, 2006 (TW) ..... 95139822 A

(51) Int. Cl.
*G09G 3/36* (2006.01)

(52) U.S. Cl. ..... 345/100; 345/208

(58) Field of Classification Search ..... 345/98, 345/100, 103, 214, 208, 690
See application file for complete search history.

(56) References Cited

U.S. PATENT DOCUMENTS 6,812,910 B2 11/2004 Chou
7,196,308 B2 * 3/2007 Okutani ..... 345/98
7,499,063 B2 * 3/2009 Ishiguchi ..... 345/100
7,742,021 B2 * 6/2010 Shin ..... 345/76
2001/0003448 A1 6/2001 Nose et al.
2004/0257328 A1 * 12/2004 Lim ..... 345/100
2005/0162448 A1 * 7/2005 Aoki ..... 345/690
2006/0071890 A1 4/2006 Kikuchi

FOREIGN PATENT DOCUMENTS

TW 589476 B 3/2006

* cited by examiner

*Primary Examiner* — Chanh Nguyen
*Assistant Examiner* — Allison Walthall
(74) *Attorney, Agent, or Firm* — Wei Te Chung

(57) ABSTRACT

An exemplary driving circuit (20) includes: gate lines (23); data lines (24); pixel units (240); a gate driving circuit (21); a data driving circuit (22); a signal output circuit configured for providing a set of signals in each frame, each signal in the set of signals selectively being a black signal or a white signal; and a select output circuit (26) configured for receiving the data signals from the data driving circuit and the set of signals from the signal output circuit. When a signal of the set of signals provided by the signal output circuit is a black signal, the select output circuit provides the black signal to a corresponding data line. When a signal of the set of signals provided by the signal output circuit is a white signal, the select output circuit provides a corresponding one of the data signals to the corresponding data line.

18 Claims, 5 Drawing Sheets

DRIVING CIRCUIT, DRIVING METHOD, AND LIQUID CRYSTAL DISPLAY USING SAME

FIELD OF THE INVENTION

The present invention relates to driving circuits of liquid crystal displays (LCDs), and particularly to a driving circuit which includes a signal output circuit for alternately outputting black or white signals and inverse black or white signals in every frame.

GENERAL BACKGROUND

A typical LCD has the advantages of portability, low power consumption, and low radiation. The LCD has been widely used in various portable information products such as notebooks, personal digital assistants (PDAs), video cameras, and the like. Furthermore, the LCD is considered by many to have the potential to completely replace CRT (cathode ray tube) monitors and televisions. An LCD generally includes a liquid crystal panel, a driving circuit for driving the liquid crystal panel, and a backlight module for illuminating the liquid crystal panel.

FIG. 8 is essentially an abbreviated circuit diagram of a typical driving circuit 10 of an LCD. The driving circuit 10 includes a number n (where n is a natural number) of gate lines 13 that are parallel to each other and that each extend along a first direction, a number m (where m is also a natural number) of data lines 14 that are parallel to each other and that each extend along a second direction orthogonal to the first direction, a plurality of thin film transistors (TFTs) 15 that function as switching elements, a plurality of pixel electrodes 16, a gate driving circuit 11, and a data driving circuit 12. The plurality of gate lines 13 and the plurality of data lines 14 cross each other, thereby defining an array of pixel units of the LCD. The gate driving circuit 11 is configured to provide scanning signals to the gate lines 13. The data driving circuit 12 is configured to provide data signals to the data lines 14.

Each TFT 15 is provided in the vicinity of a respective point of intersection of the gate lines 13 and the data lines 14. A gate electrode, a source electrode, and a drain electrode of the TFT 15 are connected to a corresponding gate line 13, a corresponding data line 14, and a corresponding pixel electrode 16 respectively.

Referring also to FIG. 9, this is a waveform diagram of driving signals of the driving circuit 10. $G_1$-$G_n$ show waveforms of scanning signals generated by the gate driving circuit 11. $V_d$ shows a waveform of data signals generated by the data driving circuit 12. A driving method of the driving circuit 10 is as follows:

During a first frame, the gate driving circuit 11 generates a plurality of scanning signals 19, and applies the scanning signals 19 to the gate lines 13. The scanning signals 19 are high voltage signals. When one of the gate lines 13 has a scanning signal 19 applied thereto, the corresponding row of TFTs 15 are switched on by the high voltage. At the same time, the data driving circuit 12 applies a plurality of data signals Vd (which represent pixel data PD of the first frame) to the pixel electrodes 16 via the data lines 14 and the row of activated TFTs 15. Before a scanning signal 19' of a second frame next to the first frame is applied to the gate line 13, the pixel data PD displayed on the row of pixel units remains the same. When the scanning signal 19' of the second frame is applied to the gate line 13, the row of TFTs 15 are switched on again by the high voltage. At the same time, the data driving circuit 12 applies a plurality of data signals Vd' (which represent pixel data PD' of the second frame) to the pixel electrodes 16 via the data lines 14 and the row of activated TFTs 15. Thereby, the row of pixel units display the pixel data PD' of the second frame.

However, because a response speed of liquid crystal molecules at the pixel electrodes 16 of the LCD is low, a residual image phenomenon may occur. In particular, when the data signals are changed from Vd to Vd', the liquid crystal molecules may be unable to track the variation within a single frame period, and instead produce a cumulative response during several frame periods.

What is needed, therefore, is a driving circuit and a driving method of an LCD that can overcome the above-described deficiencies. What is also needed is an LCD using such a driving circuit.

SUMMARY

In one preferred embodiment, a driving circuit includes: a plurality of substantially parallel gate lines; a plurality of substantially parallel data lines crossing the gate lines thereby defining a plurality of pixel units; a gate driving circuit configured for providing scanning signals to the gate lines; a data driving circuit configured for providing data signals; a signal output circuit configured for providing a set of signals in each frame, each signal in the set of signals selectively being a black signal or a white signal; and a select output circuit configured for receiving the data signals from the data driving circuit and the set of signals from the signal output circuit. When a signal of the set of signals provided by the signal output circuit is a black signal, the select output circuit provides the black signal to a corresponding one of the data lines. When a signal of the set of signals provided by the signal output circuit is a white signal, the select output circuit provides a corresponding one of the data signals to the corresponding data line. Over the duration of two adjacent frames, each pixel unit displays both a black image corresponding to the black signal and a normal image corresponding to the white signal, in a sequence according to the corresponding selected signal of the set of signals for each of the two adjacent frames.

Other novel features and advantages will become more apparent from the following detailed description when taken in conjunction with the accompanying drawings. In the drawings, all the views are schematic.

DETAILED DESCRIPTION OF PREFERRED EMBODIMENTS

Figure 1:
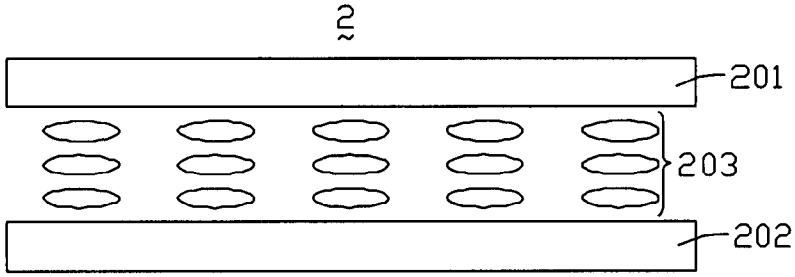
FIG. 1 is side, cross-sectional view of an LCD according to a first embodiment of the present invention, the LCD including a driving circuit (not shown).

Referring to FIG. 1, an LCD 2 according to a first embodiment of the present invention is shown. The LCD 2 includes a first substrate 201, a second substrate 202, a liquid crystal layer 203 sandwiched between the first substrate 201 and the second substrate 202, and a driving circuit (not shown).

Figure 2:
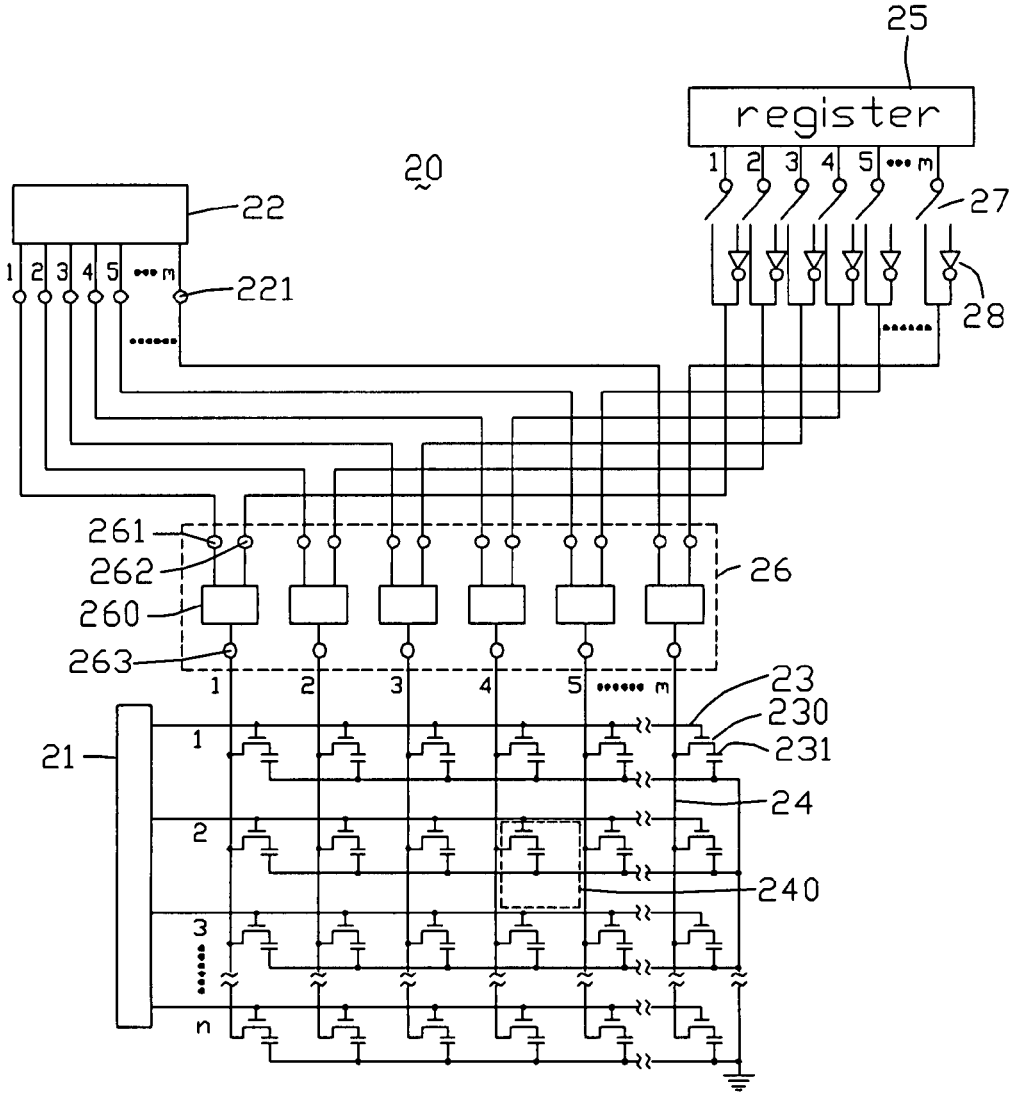
FIG. 2 is essentially an abbreviated circuit diagram of the driving circuit of the LCD of the first embodiment, the driving circuit including a register.

Referring to FIG. 2, the driving circuit 20 includes a number n (where n is a natural number) of gate lines 23 that are parallel to each other and that each extend along a first direction, a number m (where m is an even natural number) of data lines 24 that are parallel to each other and that each extend along a second direction orthogonal to the first direction, a plurality of thin film transistors (TFTs) 230 that function as switching elements, a plurality of pixel electrodes 231, a gate driving circuit 21, a data driving circuit 22, a signal output circuit (not labeled), and a select output circuit 26. The plurality of gate lines 23 and the plurality of data lines 24 cross each other, thereby defining an array of pixel units 240 of the LCD 2. The gate driving circuit 21 is configured to provide scanning signals to the gate lines 23. The data driving circuit 22 includes the number m of signal output terminals 221, which are configured to output data signals.

Each TFT 230 is provided in the vicinity of a respective point of intersection of the gate lines 23 and the data lines 24. A gate electrode, a source electrode, and a drain electrode of each TFT 231 are connected to a corresponding gate line 23, a corresponding data line 24, and a corresponding pixel electrode 231 respectively.

The signal output circuit includes a register 25, the number m of switches 27, and the number m of inverters 28. The register 25 is configured to store a black-and-white image in the form of data in advance, and read black or white signals corresponding to the pixel units 240 from the black-and-white image data. The inverters 28 are configured to convert the black signals into white signals or convert the white signals into black signals.

The select output circuit 26 includes the number m of select output units 260. Each select output unit 260 includes a first input terminal 261, a second input terminal 262, and a select output terminal 263. The first input terminal 261 is configured to receive data signals from a corresponding signal output terminal 221 of the data driving circuit 22. The second input terminal 262 is configured to receive black and white signals from a corresponding signal output terminal (not labeled) of the register 25, or black and white signals inverted by a corresponding inverter 28. The select output terminal 263 is configured to output a data signal or a black signal to a corresponding data line 24. By controlling a corresponding switch 27, the corresponding signal output terminal of the register 25 can directly provide a black or white signal to the second input terminal 262, or provide a black or white signal inverted by the corresponding inverter 28 to the second input terminal 262.

Figure 3:
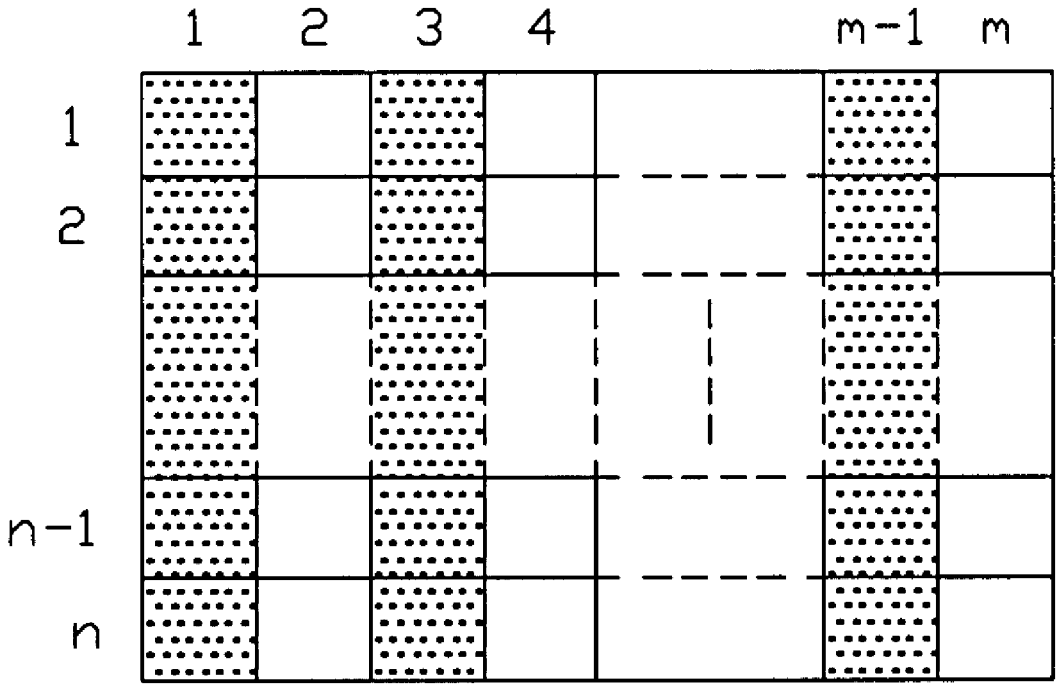
FIG. 3 is an abbreviated view of a black-and-white image, which is stored in the form of data in the register of the driving circuit of FIG. 2.

Referring to FIG. 3, this shows the visual form of the black-and-white image that is stored in the register 25 in the form of data. The black-and-white image includes a plurality of rectangular regions corresponding to the pixel units 240 of the LCD 20. Odd-column rectangular regions are black, and even-column rectangular regions are white. That is, the odd-column rectangular regions correspond to black signals, and the even-column rectangular regions correspond to white signals.

Figure 4:
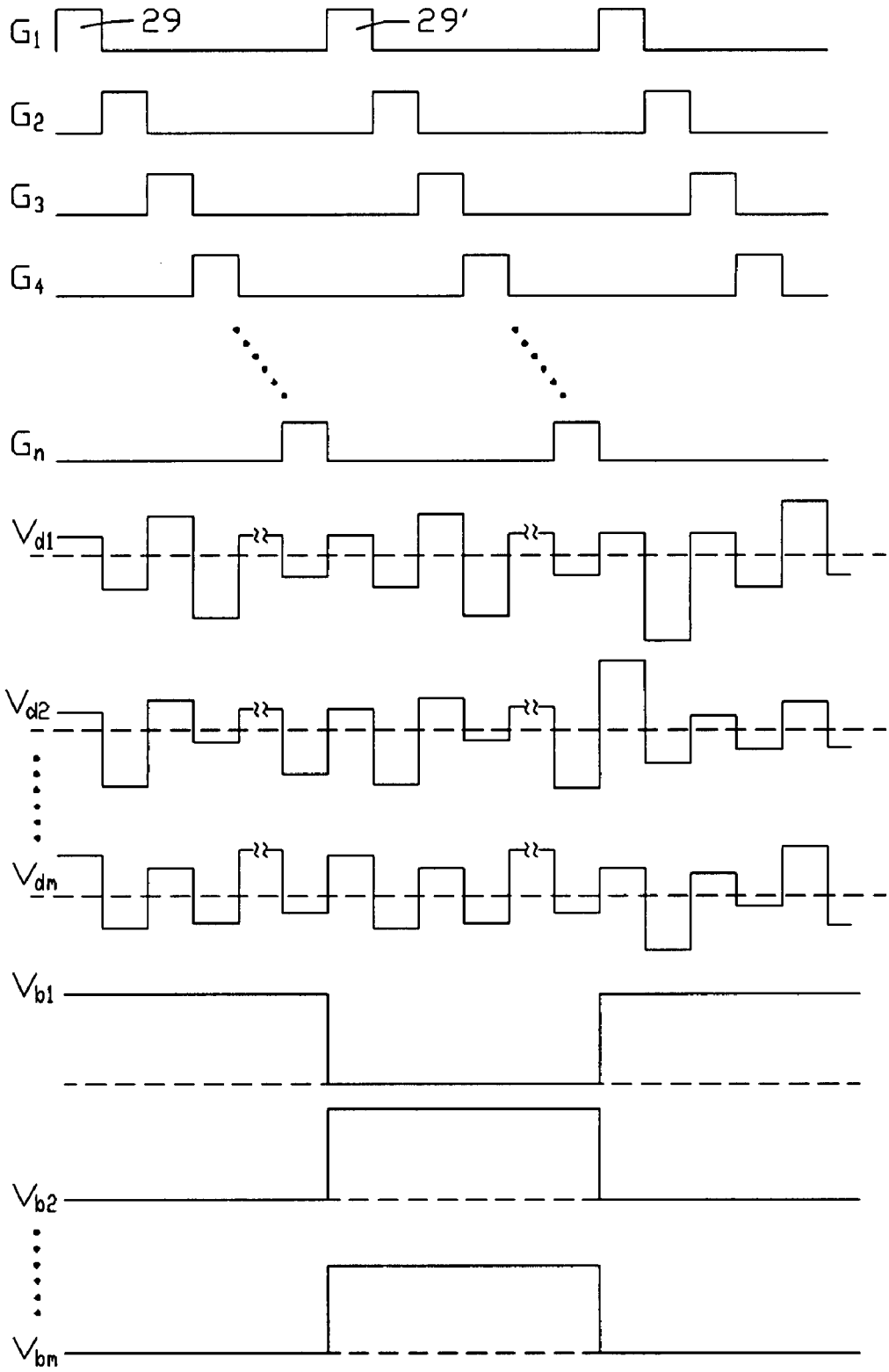
FIG. 4 is an abbreviated waveform diagram of driving signals of the driving circuit of FIG. 2.

Referring to FIG. 4, this is a waveform diagram of driving signals of the driving circuit 20. $G_1$-$G_n$ show waveforms of scanning signals generated by the gate driving circuit 21. $V_{d1}$-$V_{dm}$ show waveforms of data signals generated by the data driving circuit 22. $V_{b1}$-$V_{bm}$ show waveforms of the black and white signals as applied to the select output circuit 26. An exemplary driving method of the driving circuit 20 is as follows:

During a first frame, the gate driving circuit 21 generates a plurality of scanning signals 29, and applies the scanning signals 29 to the gate lines 23. The scanning signals 29 are high voltage signals. When one of the gate lines 23 has a scanning signal 29 applied thereto, the corresponding row of TFTs 230 are switched on by the high voltage.

At the same time, the signal output terminals 221 of the data driving circuit 22 output a plurality of data signals $V_{d1}$-$V_{dm}$ of the first frame to the first input terminals 261 of the select output units 260 respectively, and the register 25 outputs a plurality of black and white signals $V_{b1}$-$V_{bm}$ directly to the second input terminals 262 of the select output units 260 respectively. Odd-column second output terminals 262 receive black signals, and accordingly odd-column select output terminals 263 output the black signals to odd-column data lines 24 respectively. The black signals are applied to odd-column pixel units 240 via the odd-column data lines 24 and odd-column activated TFTs 230. Even-column second input terminals 262 receive white signals, and accordingly even-column select output terminals 263 output the data signals to even-column data lines 24 respectively. The data signals are applied to even-column pixel units 240 via the even-column data lines 24 and even-column activated TFTs 230. Thus, in the first frame, the odd-column pixel units 240 of the LCD 2 display black images, and the even-column pixel units 240 of the LCD 2 display normal images.

During a second frame, the gate driving circuit 21 generates a plurality of scanning signals 29', and applies the scanning signals 29' to the gate lines 23 respectively. The scanning signals 29' are high voltage signals. When one of the gate lines 23 has a scanning signal 29' applied thereto, the corresponding row of TFTs 230 are switched on by the high voltage.

At the same time, the signal output terminals 221 of the data driving circuit 22 output the plurality of data signals $V_{d1}$-$V_{dm}$ of the first frame to the first input terminals 261 of the select output units 260, and the register 25 outputs the plurality of black and white signals $V_{b1}$-$V_{bm}$ of the first frame. However, the switches 27 are switched such that the black and white signals $V_{b1}$-$V_{bm}$ are inverted by the inverters 28, whereupon the inverted black and white signals $V_{b1}$-$V_{bm}$ are input to the second input terminals 262 of the select output units 260. The odd-column second output terminals 262 receive white signals, and accordingly the odd-column select output terminals 263 output the data signals to the odd-column data lines 24 respectively. The data signals are applied to the odd-column pixel units 240 via the odd-column data lines 24 and the odd-column activated TFTs 230. The even-column second input terminals 262 receive black signals, and accordingly the even-column select output terminals 263 output the black signals to the even-column data lines 24 respectively. The black signals are applied to the even-column pixel units 240 via the even-column data lines 24 and the even-column activated TFTs 230. Thus, in the second frame, the odd-column pixel units 240 of the LCD 2 display normal images, and the even-column pixel units 240 of the LCD 2 display black images. The normal images displayed by the even-column pixel units 240 in the first frame and the normal images displayed by the odd-column pixel units 240 in the second frame are mixed as perceived by a viewer of the LCD 2, whereby a desired whole image is viewed from the standpoint of the viewer.

In the two next frames, the above steps are repeated.

In summary, the register 25, the switches 27, and the inverters 28 cooperatively form a signal output circuit. The signal output circuit outputs black and white signals alternately arranged by column to the select output circuit 26 in the first frame, and outputs black and white signals with an inverse arrangement in the second frame. Thus, each pixel unit 240 alternately displays normal images and black images every frame. The normal images displayed by the pixel units 240 in every two adjacent frames are mixed as perceived by the human eye, whereby a desired complete image is perceived by the viewer of the LCD 2. Because two different consecutive normal images displayed by each pixel unit 240 are always spaced by a black image, a residual image phenomenon can be avoided.

In an alternative embodiment, the register 25 stores an all-black image in the form of data. In such an embodiment, an exemplary driving method of the LCD 2 is as follows:

During a first frame, the gate driving circuit 21 generates a plurality of scanning signals 29, and applies the scanning signals 29 to the gate lines 23. The scanning signals 29 are high voltage signals. When one of the gate lines 23 has a scanning signal 29 applied thereto, the corresponding row of TFTs 230 are switched on by the high voltage.

At the same time, the signal output terminals 221 of the data driving circuit 22 output a plurality of data signals $V_{d1}$-$V_{dm}$ to the first input terminals 261 of the select output units 260, and the register 25 outputs a plurality of black signals directly to the second input terminals 262 of the select output units 260. The select output terminals 263 output the black signals to the pixel units 240 via the data lines 24 and the activated TFTs 230. Thus, in the first frame, the LCD 2 displays an all-black image.

During a second frame, the gate driving circuit 21 generates a plurality of scanning signals 29', and applies the scanning signals 29' to the gate lines 23. The scanning signals 29' are high voltage signals. When one of the gate lines 23 has a scanning signal 29' applied thereto, the corresponding row of TFTs 230 are switched on by the high voltage.

At the same time, the signal output terminals 221 of the data driving circuit 22 output the plurality of data signals $V_{d1}$-$V_{dm}$ of the first frame to the first input terminals 261 of the select output units 260, and the register 25 outputs the plurality of black signals. However, the switches 27 are switched such that the black signals are inverted to white signals by the inverters 28, whereupon the white signals are input to the second input terminals 262 of the select output units 260. Accordingly, the select output terminals 263 output the data signals to the pixel units 240 via the data lines 24 and the activated TFTs 230. Thus, in the second frame, the LCD 2 displays a normal image.

In two next frames, the above steps are repeated. Because two different consecutive normal images displayed by the pixel units 240 are always spaced by an all-black image, a residual image phenomenon can be avoided.

Figure 5:
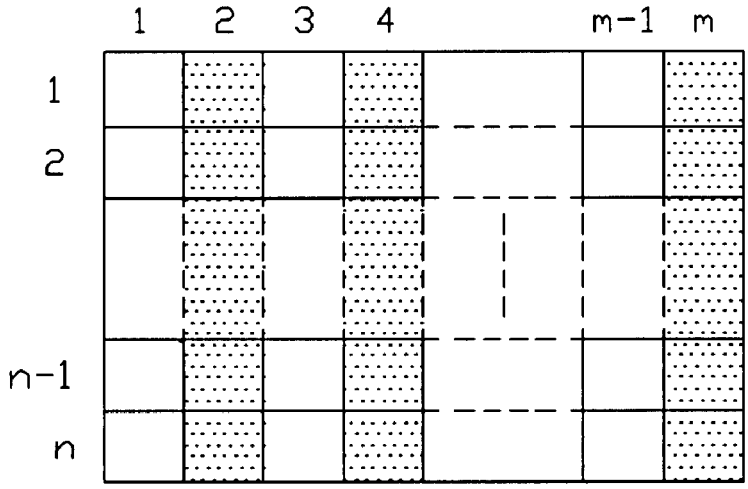
FIG. 5 is an abbreviated view of a black-and-white image, which is stored in the form of data in a register of a driving circuit of an LCD according to a second embodiment of the present invention.

Referring to FIG. 5, this shows the visual form of a black-and-white image that is stored in the form of data in a register of a driving circuit of an LCD according to a second embodiment of the present invention. The black-and-white image includes a plurality of rectangular regions. Odd-column rectangular regions are white, and even-column rectangular regions are black. That is, the odd-column rectangular regions correspond to white signals, and the even-column rectangular regions correspond to black signals.

Figure 6:
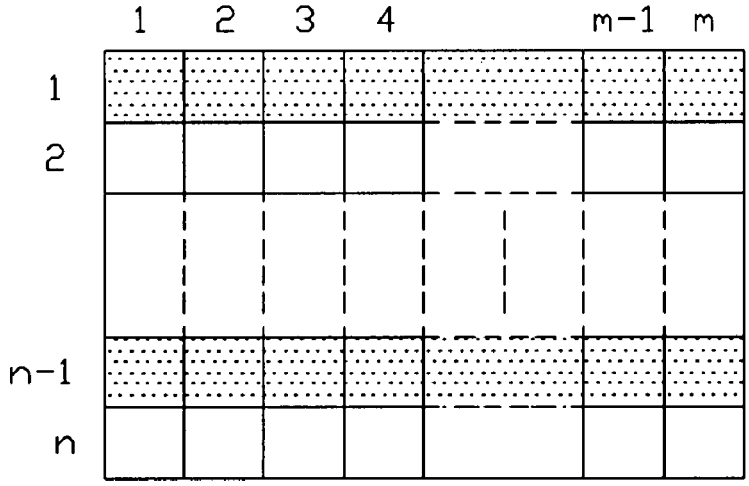
FIG. 6 is an abbreviated view of a black-and-white image, which is stored in the form of data in a register of a driving circuit of an LCD according to a third embodiment of the present invention.

Referring to FIG. 6, this shows the visual form of a black-and-white image that is stored in the form of data in a register of a driving circuit of an LCD according to a third embodiment of the present invention. The black-and-white image includes a plurality of rectangular regions. Odd-row rectangular regions are black, and even-row rectangular regions are white. That is, the odd-row rectangular regions correspond to black signals, and the even-row rectangular regions correspond to white signals.

Figure 7:
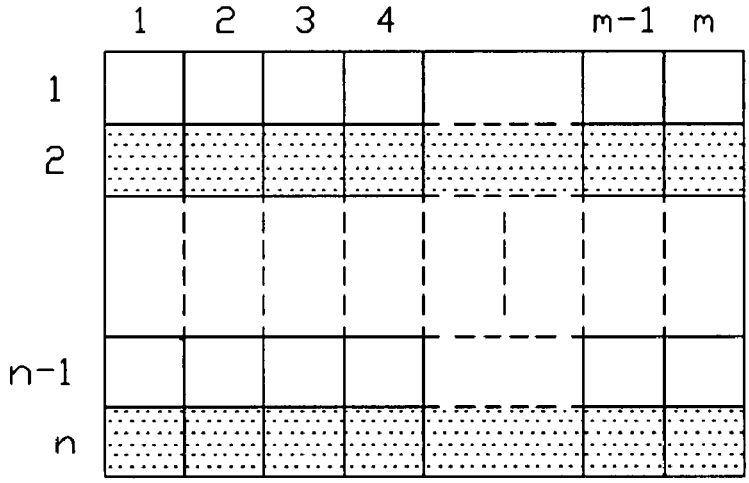
FIG. 7 is an abbreviated view of a black-and-white image, which is stored in the form of data in a register of a driving circuit of an LCD according to a fourth embodiment of the present invention.
Figure 8:
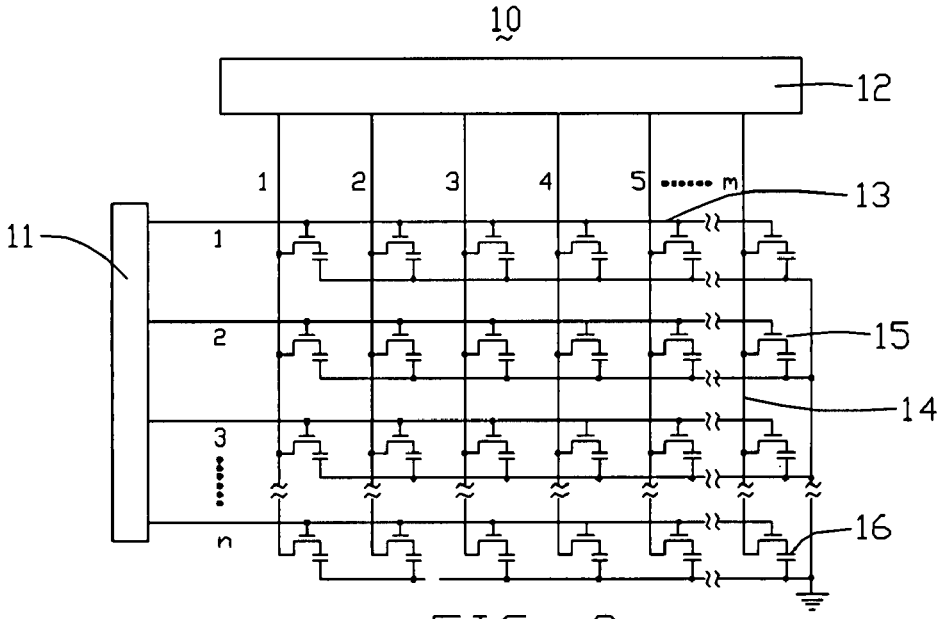
FIG. 8 (RELATED ART)
FIG. 8 is essentially an abbreviated circuit diagram of a conventional driving circuit of an LCD.
Figure 9:
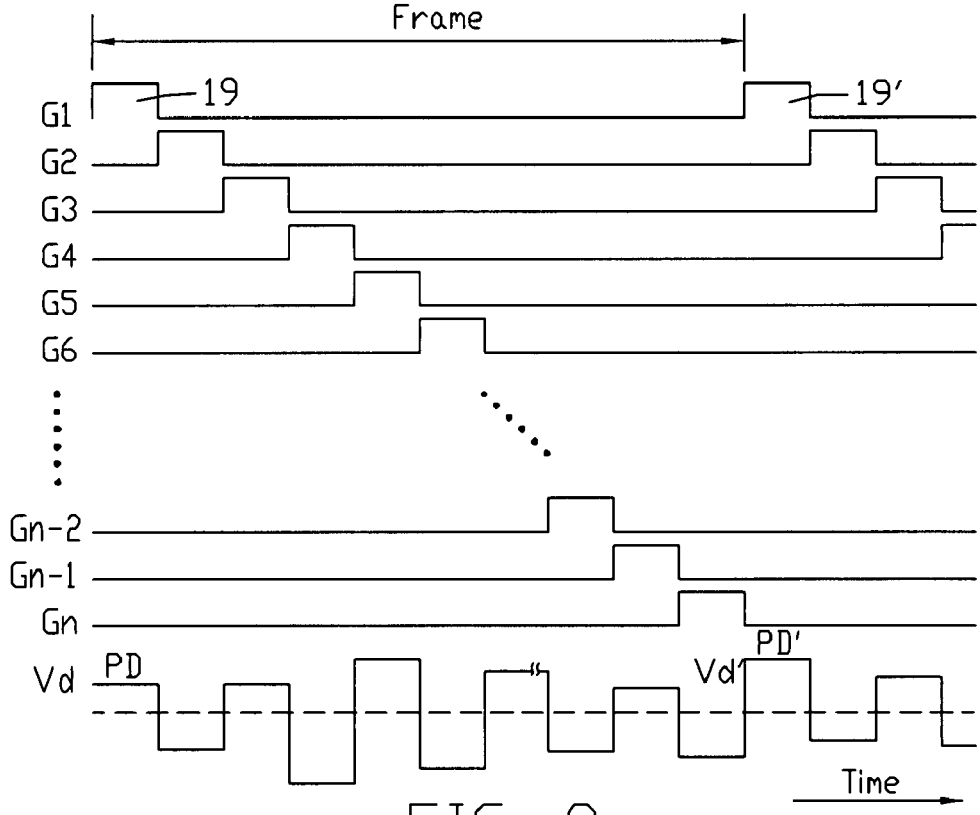
FIG. 9 (RELATED ART)
FIG. 9 is an abbreviated waveform diagram of driving signals of the driving circuit of FIG. 8.

Referring to FIG. 7, this shows the visual form of a black-and-white image that is stored in the form of data in a register of a driving circuit of an LCD according to a fourth embodiment of the present invention. The black-and-white image includes a plurality of rectangular regions. Odd-row rectangular regions are white, and even-row rectangular regions are black. That is, the odd-row rectangular regions correspond to white signals, and the even-row rectangular regions correspond to black signals.

It is to be further understood that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A driving circuit comprising:

a plurality of substantially parallel gate lines;

a plurality of substantially parallel data lines crossing the gate lines thereby defining a plurality of pixel units;

a gate driving circuit configured for providing scanning signals to the gate lines;

a data driving circuit configured for providing data signals;

a signal output circuit configured for providing a set of signals in each frame, each signal in the set of signals selectively being a black signal or a white signal; and a select output circuit configured for receiving the data signals from the data driving circuit and the set of signals from the signal output circuit;

wherein when a signal of the set of signals provided by the signal output circuit is the black signal, the select output circuit provides the black signal to a corresponding one of the data lines, and when a signal of the set of signals provided by the signal output circuit is the white signal, the select output circuit provides a corresponding one of the data signals to the corresponding data line; and over the duration of two adjacent frames, each pixel unit displays both a black image corresponding to the black signal and a normal image corresponding to the white signal, in a sequence according to the corresponding selected signal of the set of signals for each of the two adjacent frames, wherein the select output circuit comprises a plurality of select output units, each select output unit comprising a first input terminal configured for receiving the data signals from the data driving circuit, a second input terminal configured for receiving the set of signals from the signal output circuit, and a select output terminal configured for selectively outputting the data signals and black signals to the data lines, wherein the signal output circuit comprises a register, a plurality of inverters, and a plurality of switches, the register being configured for storing an image in the form of data, reading signals corresponding to the pixel units from the image data, and providing the signals, and by controlling a corresponding switch, the register directly provides a signal to the second input terminal, or provides a signal inverted by the corresponding inverter to the second input terminal.

2. The driving circuit as claimed in claim 1, wherein the image stored in the register in the form of data is an all-black image.

3. The driving circuit as claimed in claim 1, wherein the image stored in the register in the form of data is a black-and-white image.

4. The driving circuit as claimed in claim 3, wherein the black-and-white image includes a plurality of rectangular regions corresponding to the pixel units, and the rectangular regions comprises black regions corresponding to black signals and white regions corresponding to white signals.

5. The driving circuit as claimed in claim 4, wherein the black regions and the white regions are alternately arranged by columns.

6. The driving circuit as claimed in claim 5, wherein odd-column rectangular regions are the black regions and even-column rectangular regions are the white regions.

7. The driving circuit as claimed in claim 5, wherein odd-column rectangular regions are the white regions and even-column rectangular regions are the black regions.

8. The driving circuit as claimed in claim 4, wherein the black regions and the white regions are alternately arranged by rows.

9. The driving circuit as claimed in claim 8, wherein odd-row rectangular regions are the black regions and even-row rectangular regions are the white regions.

10. The driving circuit as claimed in claim 8, wherein odd-row rectangular regions are the white regions and even-row rectangular regions are the black regions.

11. A liquid crystal display (LCD) comprising:

a first substrate;

a second substrate;

a liquid crystal layer sandwiched between the first and second substrates; and a driving circuit comprising:

a plurality of substantially parallel gate lines;

a plurality of substantially parallel data lines crossing the gate lines thereby defining a plurality of pixel units;

a gate driving circuit configured for providing scanning signals to the gate lines;

a data driving circuit configured for providing data signals;

a signal output circuit configured for providing a set of signals in each frame, each signal in the set of signals selectively being a black signal or a white signal; and a select output circuit configured for receiving the data signals from the data driving circuit and the set of signals from the signal output circuit;

wherein when a signal of the set of signals provided by the signal output circuit is the black signal, the select output circuit provides the black signal to a corresponding one of the data lines, and when a signal of the set of signals provided by the signal output circuit is the white signal, the select output circuit provides a corresponding one of the data signals to the corresponding data line; and over the duration of two adjacent frames, each pixel unit displays both a black image corresponding to the black signal and a normal image corresponding to the white signal, in a sequence according to the corresponding selected signal of the set of signals for each of the two adjacent frames, wherein the select output circuit comprises a plurality of select output units, each select output unit comprising a first input terminal configured for receiving the data signals from the data driving circuit, a second input terminal configured for receiving the set of signals from the signal output circuit, and a select output terminal configured for selectively outputting the data signals and black signals to the data lines, wherein the signal output circuit comprises a register, a plurality of inverters, and a plurality of switches, the register being configured for storing an image in the form of data, reading signals corresponding to the pixel units from the image data, and providing the signals, and by controlling a corresponding switch, the register directly provides a signal to the second input terminal, or provides a signal inverted by the corresponding inverter to the second input terminal.

12. The LCD as claimed in claim 11, wherein the image stored in the register in the form of data is an all-black image.

13. The LCD as claimed in claim 11, wherein the image stored in the register in the form of data is a black-and-white image.

14. A driving method for a driving circuit, wherein the driving circuit comprises a plurality of gate lines, a plurality of data lines crossing the gate lines thereby defining a plurality of pixel units, a gate driving circuit configured for providing scanning signals to the gate lines, a data driving circuit configured for providing data signals, a signal output circuit configured for selectively outputting black signals and white signals, and a select output circuit configured for receiving the data signals from the data driving circuit and the selected black signals and white signals from the signal output circuit, the signal output circuit comprising a register and a plurality of inverters, the register storing an image in the form of data, the method comprising:

generating a plurality of scanning signals and applying the scanning signals to the gate lines by the gate driving circuit in a first frame;

in the first frame, providing a plurality of data signals to the select output circuit by the data driving circuit, reading and providing a first set of signals corresponding to the image data by the register, and providing the first set of signals to the select output circuit by the signal output circuit, wherein each signal of the first set of signals is selectively a black signal or a white signal;

generating a plurality of scanning signals and applying the scanning signals to the gate lines by the gate driving circuit in a second frame next to the first frame; and in the second frame, providing a plurality of data signals to the select output circuit by the data driving circuit, reading and providing the first set of signals corresponding to the image data by the register, changing the first set of signals to a second set of signals by the inverters, and providing the second set of signals to the select output circuit by the signal output circuit, wherein each signal of the second set of signals corresponds to a respective signal of the first set of signals and is a black signal when said respective signal is a white signal or a white signal when said respective signal is a black signal;

wherein when a signal provided by the signal output circuit is a black signal, the select output circuit provides the black signal to a corresponding one of the data lines, and when a signal provided by the signal output circuit is a white signal, the select output circuit provides a corresponding one of the data signals to a corresponding one of the data lines.

15. The method as claimed in claim 14, wherein the signal output circuit further comprises a plurality of switches, by controlling the plurality of switches, in the first frame, the register provides the first set of signals to the signal output circuit, and in the second frame, the register provides the first set of signals to the inverters, the inverters changes the first set of signals to the second set of signals and provides the second set of signals to the signal output circuit.

16. The method as claimed in claim 15, wherein the select output circuit comprises a plurality of select output units, each select output unit comprising a first input terminal configured for receiving data signals from the data driving circuit, a second input terminal configured for receiving the black signals and white signals of the first sets of signals and the second set of signals, and a select output terminal configured for selectively outputting the data signals and black signals to the data lines.

17. The method as claimed in claim 15, wherein the image stored in the register in the form of data is an all-black image.

18. The method as claimed in claim 15, wherein the image stored in the register in the form of data is a black-and-white image, and the black-and-white image includes a plurality of rectangular regions corresponding to the pixel units, and the rectangular regions comprises black regions corresponding to black signals and white regions corresponding to white signals.

* * * * *